US005998715A

United States Patent [19]

Rovner

[11] Patent Number: 5,998,715

[45] Date of Patent: Dec. 7, 1999

[54] MULTI-TONAL LIGATURE

[76] Inventor: Philip L. Rovner, 10705 Cardington Way, Cockeysville, Md. 21030

[21] Appl. No.: 08/919,144

[22] Filed: Aug. 27, 1997

[51] Int. Cl.[6] ..... G10D 9/02

[52] U.S. Cl. ..... 84/383 R; 84/383 R

[58] Field of Search ..... 84/380 R, 383 R

[56] References Cited

U.S. PATENT DOCUMENTS

| | | | |
|---|---|---|---|
| 3,257,888 | 6/1966 | Krechmer | 84/383 |
| 3,521,517 | 7/1970 | Sato | 84/383 |
| 3,791,253 | 2/1974 | Pascucci et al. | 84/383 |
| 4,080,866 | 3/1978 | Toof | 84/383 R |
| 4,428,271 | 1/1984 | Winslow et al. | 84/383 R |
| 4,745,838 | 5/1988 | Johnson | 84/383 R |
| 4,941,385 | 7/1990 | Johnson | 84/383 R |
| 5,000,073 | 3/1991 | Hite | 84/383 R |
| 5,018,425 | 5/1991 | Rovner | 84/383 R |
| 5,398,582 | 3/1995 | Smith | 84/383 R |
| 5,419,229 | 5/1995 | Van Doren | 84/383 R |
| 5,440,962 | 8/1995 | Valtchev | 84/383 R |
| 5,456,152 | 10/1995 | Cusack et al. | 84/383 R |

OTHER PUBLICATIONS

The Woodwind Catalog, Spring/Summer 1999, p. 78.

*Primary Examiner*—Robert E. Nappi
*Assistant Examiner*—Kim Lockett
*Attorney, Agent, or Firm*—Leonard Bloom

[57] ABSTRACT

A ligature for use on a mouthpiece of a woodwind musical instrument. The ligature has a flexible or semi-flexible body and can be fastened to encircle the mouthpiece and reed assembly. A cradle is connected to the inside of the body and an insert is removably received in the cradle. A plurality of inserts are provided for selection of a needed insert. Flaps are positioned over or under the cradle as needed to produce desired tonal effects.

28 Claims, 8 Drawing Sheets

MULTI-TONAL LIGATURE

BACKGROUND OF THE INVENTION

The present application relates to a ligature for a woodwind musical instrument and, more particularly, to a ligature which permits the obtaining of multiple tones from the instrument.

Ligatures are used to mount a vibrating reed element to the surface of a mouthpiece for an instrument such as a clarinet or saxophone. The design and construction of the ligature, affects the tone quality and response of the instrument. A goal of the ligature design is to permit maximum freedom of vibration to the reed.

Prior ligatures that attempt to provide a means of adjusting the quality of tone or response have done so by utilizing screw adjustments, as in the designs of Van Doren U.S. Pat. No. 5,419,229 and Cusack U.S. Pat. No. 5,456,152, or sliding bars as in Pascucci U.S. Pat. No. 3,791,253, or a plurality of pressure pins as in Winslow U.S. Pat. No. 4,428,271. Those using pressure adjustments may not achieve satisfactory performance throughout the range of adjustment. Those requiring extensive assembly and disassembly are not convenient to use. In the design of the present invention, alteration in tone and response are achieved by changing the virtual mass of the cradle, in combination with having the reed in contact with either metal or rubber, thus achieving a diversity of tone with no sacrifice in performance, and having uniqueness in comparison with the prior art. Also, this has been achieved in a less complex manner and with greater ease of use than in many prior ligatures.

BRIEF SUMMARY OF THE INVENTION

It is an object of the present invention to provide a ligature which permits a variety of tonal effects and differences in response to be obtained rapidly with a minimum of manipulations.

In accordance with the teaching of the present invention, there is disclosed a ligature for use on a mouthpiece of a woodwind type musical instrument having a reed. The ligature has a flexible or semi-flexible body having an inside surface. Fastening means are provided to removably attach the body to the mouthpiece. A cradle is connected to the inside surface of the body. An insert is removably received in the cradle. A pair of opposing flexible flaps are attached to the inside surface of the body adjacent to the cradle, wherein the inside surface of the body is adjacent to the musical instrument and secured thereto with the fastening means. In this manner, the insert in the cradle is juxtapositioned to the reed in the mouthpiece and the flaps are disposed in a predetermined position with respect to the cradle. Desired tonal effects are obtained by selection of the insert and positioning of the flaps. The flaps may be positioned above or below the cradle.

In further accordance with the teaching of the present invention, there is disclosed a ligature for use on a mouthpiece of a woodwind type musical instrument. The ligature body is a flexible or semi-flexible unitary strip having a first end and an opposite second end, the strip is folded forming a "C" shaped body having a mouth, an outer wall and an inner wall. The ends of the strip are disposed within the outer wall opposite the mouth and forming opposing flaps as a portion of the inner wall. A respective rod is disposed within the inner wall and the outer wall on each side of the mouth. Fastening means are connected to each of the rods to permit removable attachment of the body of the ligature around the mouthpiece of the instrument. A cradle is connected to the inner wall of the body opposite to the mouth. An insert is removably retained in the cradle. In this manner the body is secured to the mouthpiece of the instrument by the fastening means with the insert in the cradle juxtapositioned to the mouthpiece and the flaps are disposed in a predetermined position with respect to the cradle. Desired tonal effects are obtained by selection of the insert and positioning of the flaps.

In another aspect there is disclosed a ligature for use on a mouthpiece of a woodwind type musical instrument having a reed. The ligature has a flexible body having an inside surface. A fastening means is provided to removably attach the flexible body to the mouthpiece. A cradle is connected to the inside surface of the flexible body. The cradle has a base having a face. A pair of spaced-apart arms are formed on the face of the base, the arms being folded toward one another. An insert is removably received between the folded arms and the face on the base. The flexible body is secured around the mouthpiece of the musical instrument by the fastening means with the insert in the cradle juxtapositioned to the reed in the mouthpiece and desired tonal effects are produced.

These and other objects of the present invention will become apparent from a reading of the following specification taken in conjunction with the enclosed drawings.

DESCRIPTION

Figure 1:
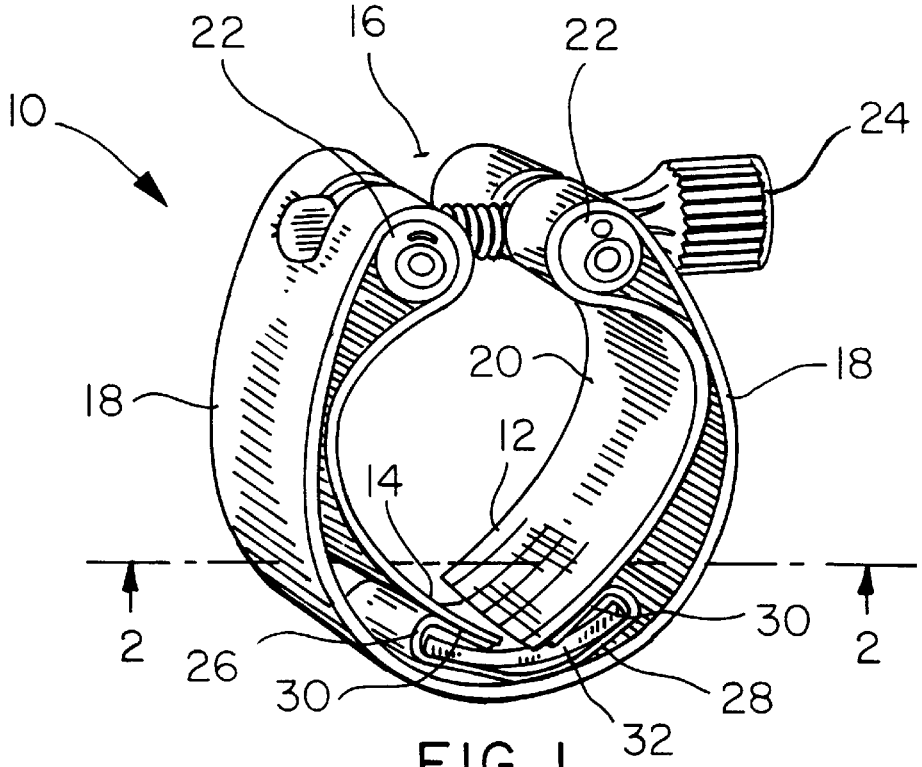
FIG. 1 is a perspective view of the ligature of the present invention.
Figure 2:
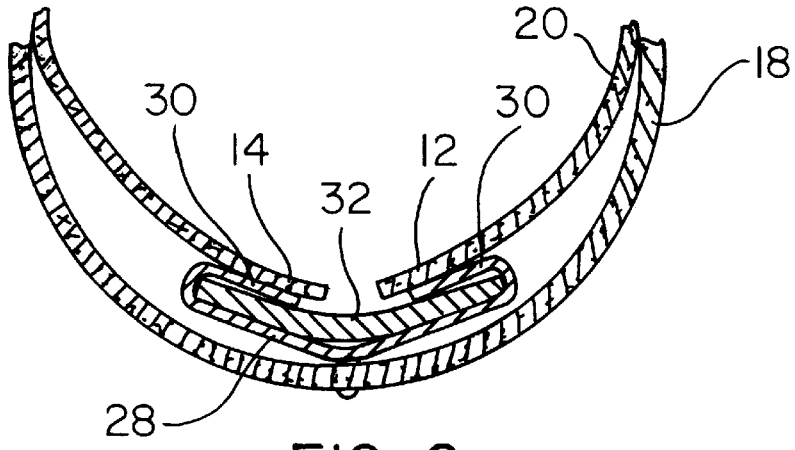
FIG. 2 is a cross-sectional view taken across the lines 2—2 of FIG. 1.

Referring now to FIGS. 1–2, the ligature 10 of the present invention is used with the mouthpiece of a woodwind type musical instrument which has a reed such as a clarinet or a saxophone. The ligature 10 has a flexible body formed from a rubberized or plasticized fabric. Preferably, the body is a unitary strip which has a first end 12 and an opposite second end 14 and the strip is folded to form a "C" shaped body. When so folded, the body has a mouth 16, an outer wall 18 and an inner wall 20. The ends 12, 14 are disposed within the outer wall 20 and opposite the mouth 16 to form opposing flaps 12, 14 as a portion of the inner wall 20. Other means of forming the flexible body may be used and the device is not limited to the "C" shaped body. In the embodiment having a "C" shaped body, a respective rod 22 is disposed between the outer wall 18 and the inner wall 20 on each side of the mouth 16. A threaded screw 24 cooperates with threads in an opening in one of the rods 22 and the screw 24 has an end which terminates at the other rod 22 such that rotation of the screw 24 varies the spacing between the rods and opens and closes the mouth 16 to permit fastening of the ligature 10 to the mouthpiece. Other adjustable clamps and fastening means known to persons skilled in the art may be used to secure the ligature to the mouthpiece.

Figure 3:
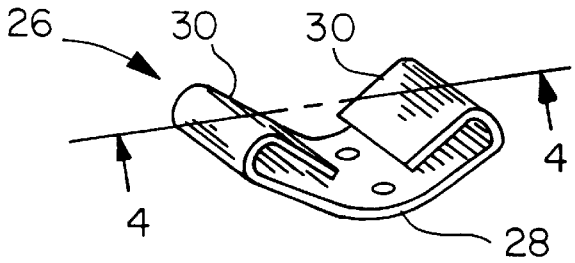
FIG. 3 is a perspective view of the cradle.
Figure 4:
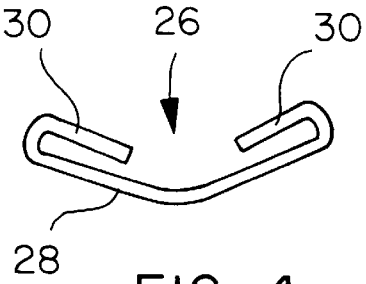
FIG. 4 is a cross-sectional view taken across the lines 4—4 of FIG. 3.

A cradle 26 is joined to the inside wall 20 of the flexible body preferably opposite to the mouth 16 (FIGS. 3–4). The cradle 26 has a base 28 with an inside face. A pair of spaced-apart arms 30 are formed on the face of the base 28 and extend upwardly from the base. The arms 30 are folded toward each other over the face of the base 28. Preferably the base 28 is bent upwardly at an approximate midpoint between the arms such that the face of the cradle 26 is slightly concave. Preferably, the cradle 26 is formed of a rigid thin spring-like material such as metal. Preferably, the cradle is formed with the thinnest material possible which will not deform in use. The cradle 26 may be attached to the body by eyelets or similar means.

Figure 5:
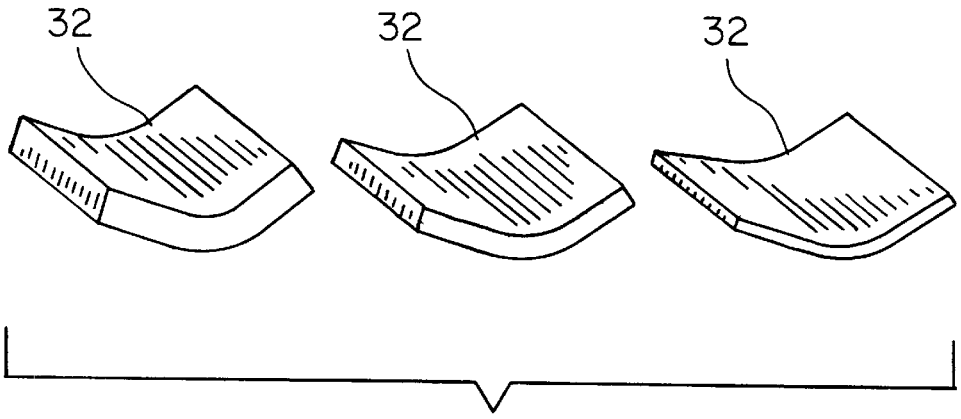
FIG. 5 is a perspective view of a plurality of inserts, each having a different thickness.
Figure 6:
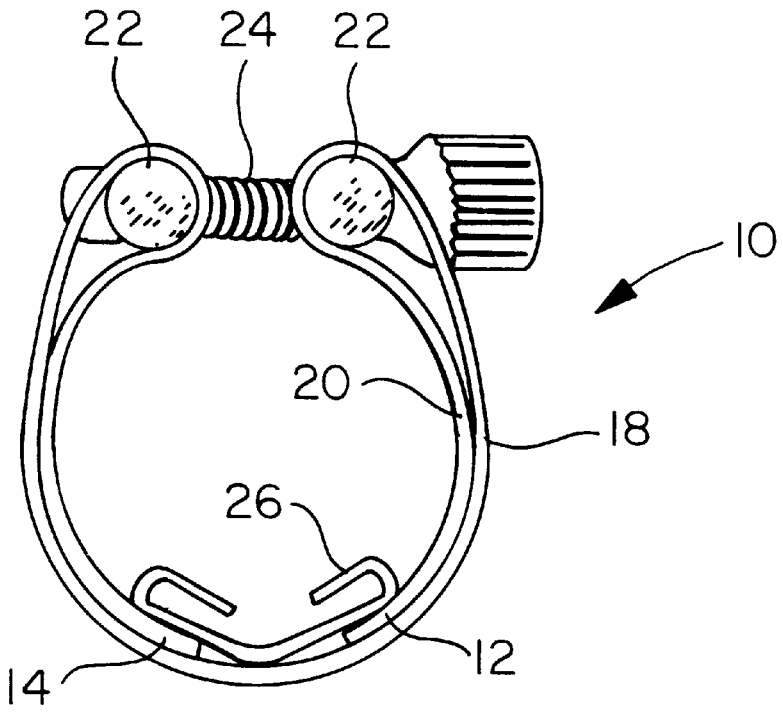
FIG. 6 is a front elevation view showing the flaps disposed under the cradle with no insert in the cradle.
Figure 7:
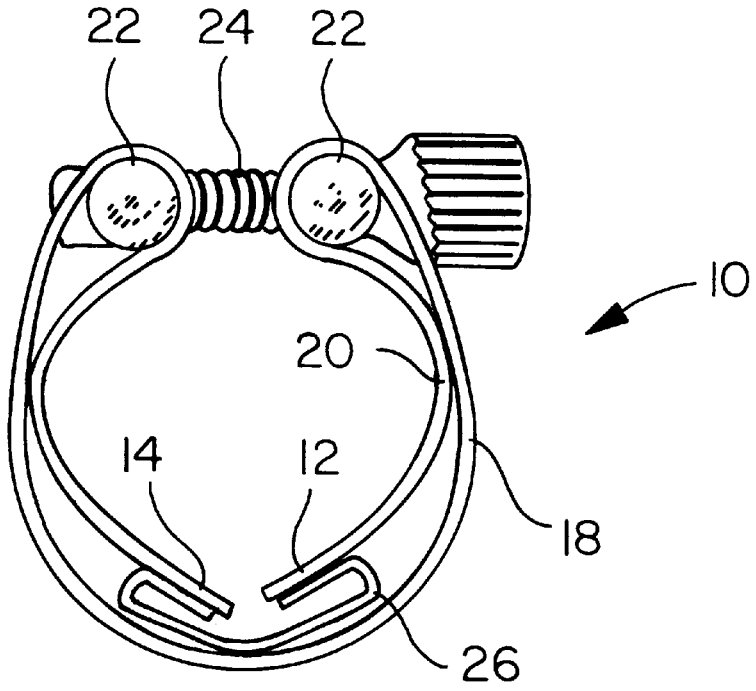
FIG. 7 is a front elevation view showing the flaps disposed over the cradle with no insert in the cradle.

An insert 32 is removably received in the cradle 26 between the face of the base 28 and the pair of arms 30. Preferably, the insert 32 is bent to cooperate with the bend or concavity of the cradle 36. The insert 32 is retained in the cradle by the friction fit between the base 28 and the arms 30 of the cradle 26. The arms 30 act in a spring-like manner. The thickness of the insert 32 may vary depending upon the tonal effect which is desired. A plurality of interchangeable inserts 32 may be provided (FIG. 5). Each insert 32 has a different thickness so that changes in tonal effects may be obtained by selection of a desired insert 32. Preferably, the edge of each arm 30 of the cradle 26 is spaced apart from the base 28 of the cradle by a space which is approximately 1½ times the thickness of the thickest insert. This distance may vary.

Figure 8:
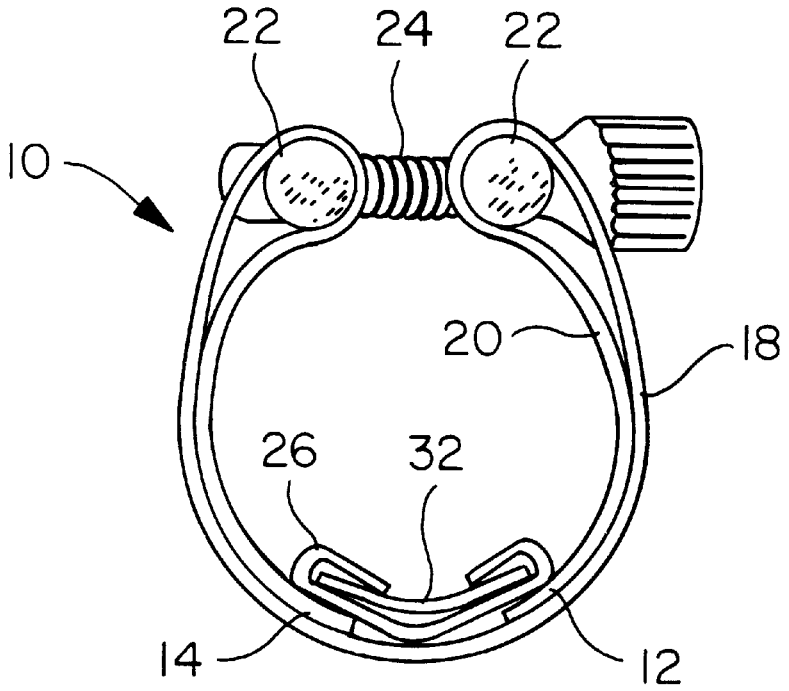
FIG. 8 is a front elevation view showing the flaps disposed under the cradle with a thin insert in the cradle.
Figure 9:
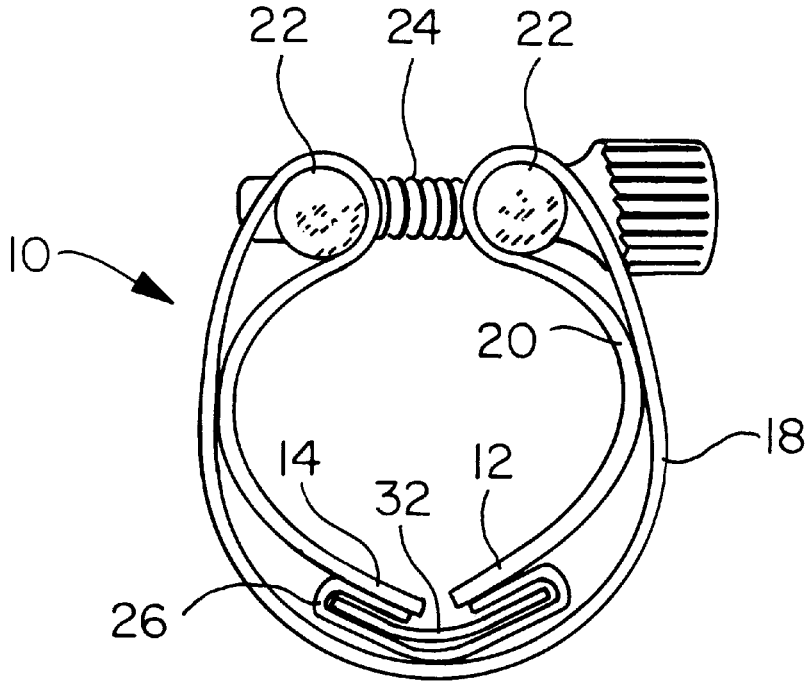
FIG. 9 is a front elevation view showing the flaps disposed over the cradle with a thin insert in the cradle.
Figure 10:
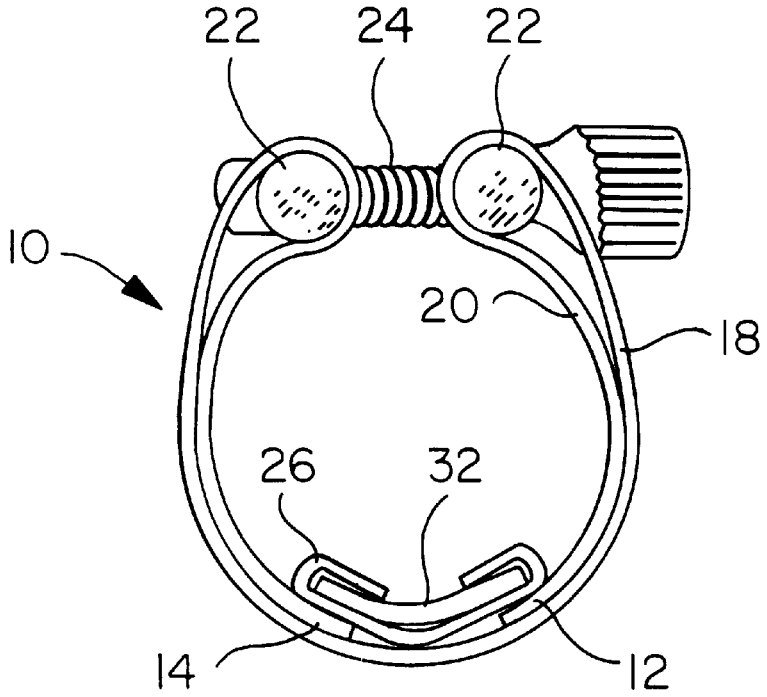
FIG. 10 is a front elevation view showing the flaps disposed under the cradle with a thick insert in the cradle.
Figure 11:
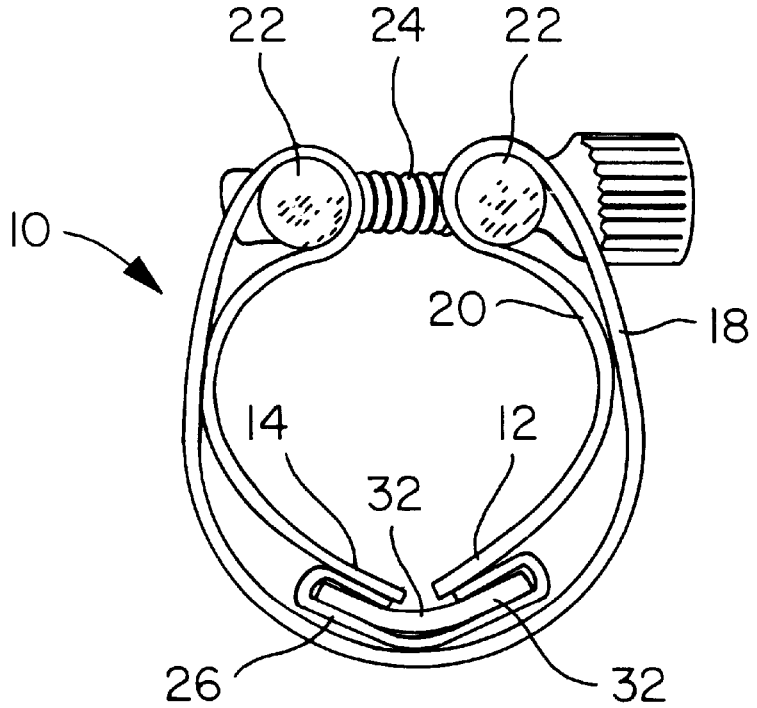
FIG. 11 is a front elevation view showing the flaps disposed over the cradle with a thick insert in the cradle.
Figure 12:
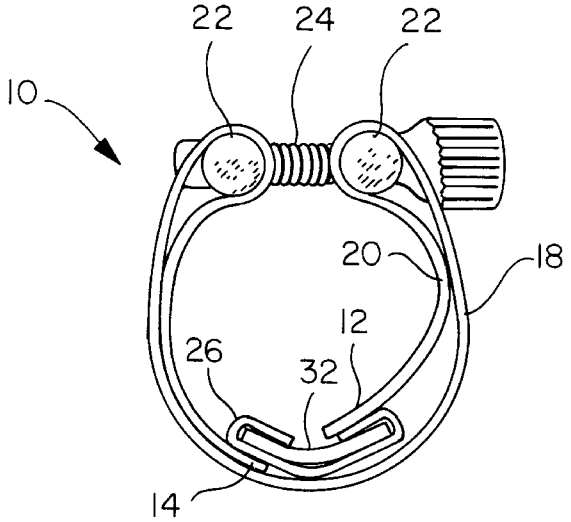
FIG. 12 is a front elevation view showing one flap disposed over the cradle and one flap disposed under the cradle with a thick insert in the cradle.

Referring now to FIGS. 6–13, the flaps 12, 14 within the ligature 10 are disposed above or below the cradle 26 as shown. The flaps 12, 14, may both be folded below the cradle 26 with no insert or both may be disposed over the respective arms 30 of the cradle 26 with no insert as in FIGS. 6 and 7. As shown in FIGS. 8 and 9, a thinner insert 32 is received in the cradle 26 with the flaps 12, 14 both under the cradle 26, or both over the respective arms 30 on the cradle 26. Another mode of use is with a thicker insert 32 in the cradle 26 and with both respective flaps 12, 14 under the cradle 26 (FIG. 10) or with both respective flaps 12, 14 over the arms 30 on the cradle 26. A further mode of use is with one flap 12 over one of the arms 30 of the cradle 26 and the other flap 14 under the cradle 26 as shown in FIG. 12. The mode may also be with the positioning of the flaps alternated, i.e., with flap 14 over the arm 30 and flap 12 under the cradle 26 (not shown). Although FIG. 12 shows an insert 32 of a selected thickness, the flaps may be disposed over and under the cradle with inserts of selected thicknesses, or without an insert.

The orientation of the flaps 12, 14 with respect to the cradle also provides a means of obtaining differing tonal effects from the ligature of the present invention.

It should be noted that the flaps shown herein are the ends 12, 14 of the unitary strip. However, the ligature need not be formed from a unitary strip and the flaps may be separate components which are disposed within the ligature adjacent to the cradle 26.

Figure 13:
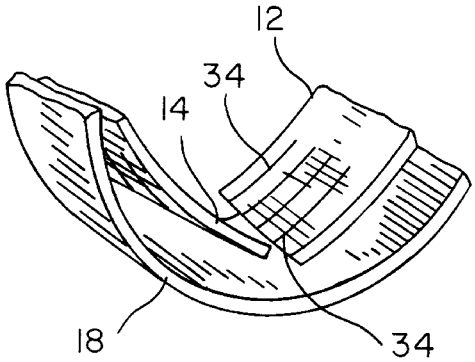
FIG. 13 is an enlarged perspective view of one of the flaps showing a plurality of spaced-apart slits formed therein.

The flaps also preferably are formed with a plurality of slits 34 formed longitudinally therein (FIG. 13). The slits 34 permit more independent vibration of the reed and thereby enhance the tonal quality produced with the ligature 10.

Figure 14:
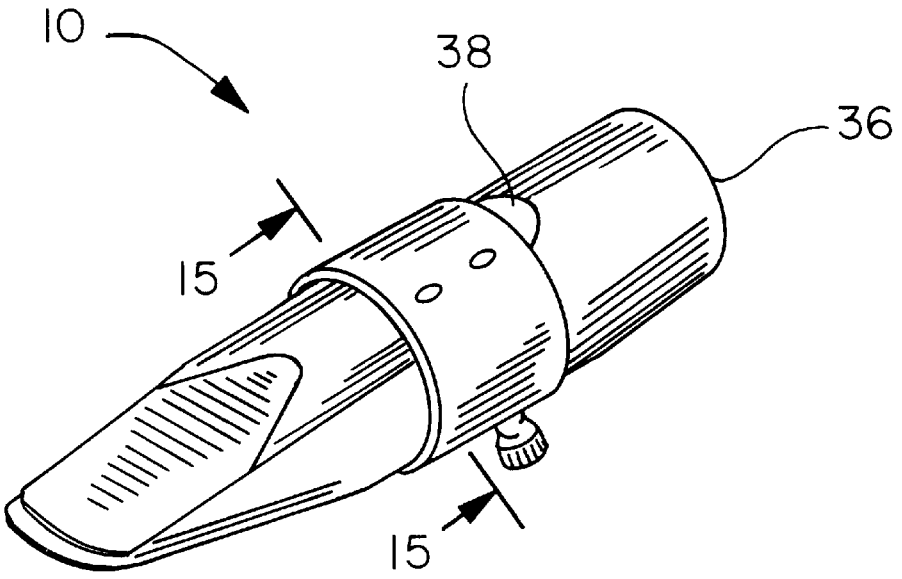
FIG. 14 is a perspective view of the mouthpiece of the musical instrument with the ligature attached thereto.
Figure 15:
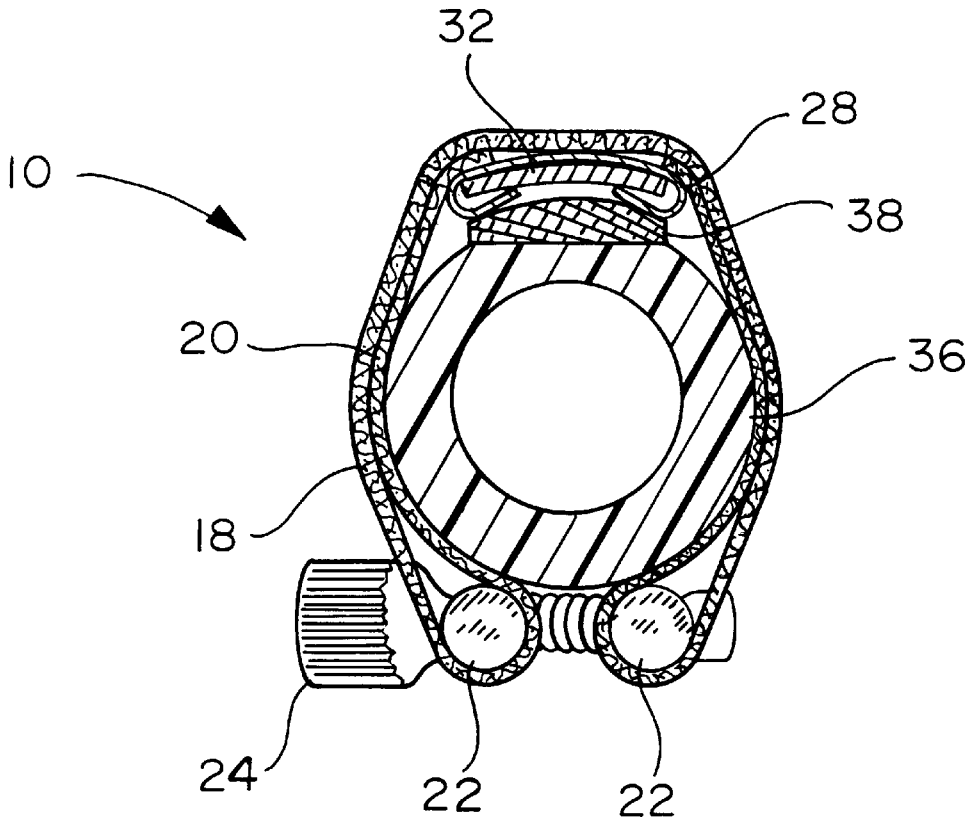
FIG. 15 is a cross-sectional view taken across the lines 15—15 of FIG. 14.

As shown in FIG. 14, the ligature 10 is mounted around the mouthpiece 36 of the musical instrument with the cradle 26 and/or the flaps 12, 14 contacting the reed 38. The user of the instrument can easily select the desired insert 32 to be placed in the cradle 26 and can also dispose the flaps 12, 14 in the desired position with respect to the cradle. No tools are required and no screws, pins or other means are needed to be added or removed to prepare the ligature for use. After the insert and flap orientation are selected, the user simply slides the ligature over the mouthpiece with the cradle 26 contacting the reed 38 and the fastening means are adjusted to secure the ligature 10 around the mouthpiece 36. Changes are made by loosening the fastening means and changing the orientation of the flaps and/or the insert as desired and resecuring the fastening means.

The contact of the cradle 26 with the reed 38 is such that approximately 30% of the reed 38 is in contact with the cradle 26. That is, approximately 15% of each side of the reed contacts the respective arms 30 on the cradle 26 with approximately 70% of the reed not contacting the cradle 26.

Figure 16:
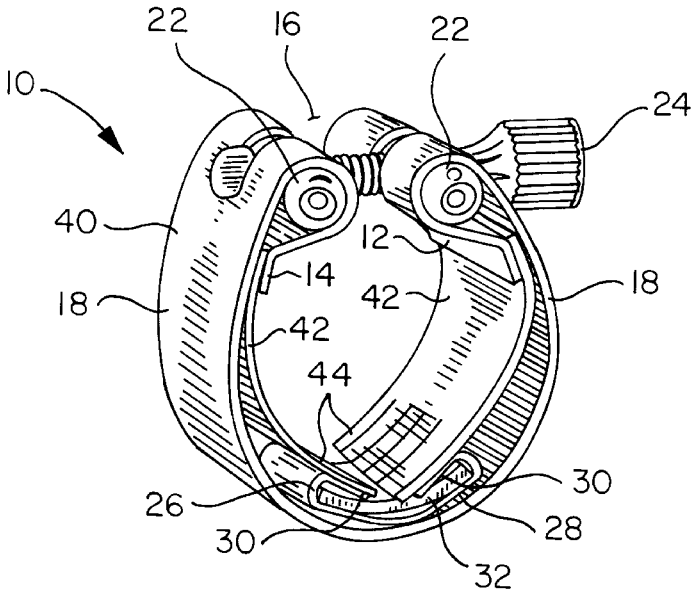
FIG. 16 is a perspective view of the ligature of the present invention formed from a semi-flexible metal.
Figure 17:
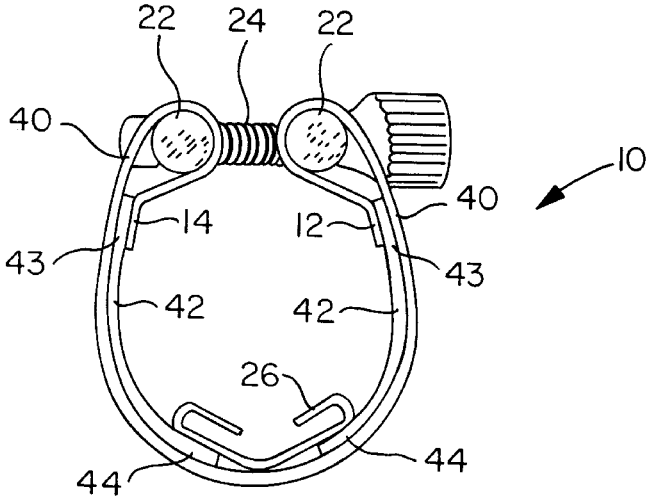
FIG. 17 is a front elevation view showing a metal body on the ligature in the embodiment with the flaps under the cradle with no insert in the cradle.

As shown in FIGS. 16 and 17, the body of the ligature may be formed of a metal strip 40 and be semi-flexible. The ends 12 and 14 terminate after folding around the respective rods 22. The ends 12 and 14 of the metal strip 40 are connected by adhesive 43 or other suitable means to a respective segment of rubberized or platicized fabric to form respective inner walls 42. Each inner wall terminates with a respective flap 44. The flaps 44 may be positioned above the cradle (as in FIG. 17), under the cradle (not shown) or one flap over the cradle and one flap under the cradle (not shown) and with no insert, a thin insert or a thick insert in a manner analogous to FIGS. 6–12.

When the ligature is used without any insert, the tone is mellow. If the cradle is directly contacting the reed the tone is brighter or somewhat more metallic than when the inner flap is interposed between the reed and cradle. Adding increasingly thicker inserts increases tonal brightness and increasingly more feel of support to the player.

Obviously, many modifications may be made without departing from the basic principle of the present invention. Accordingly, it will be appreciated by those skilled in the art that within the scope of the appended claims, the invention may be practiced other than has been specifically described herein.

I claim:

1. A ligature for use on a mouthpiece of a woodwind type musical instrument having a reed, the ligature comprising:

a flexible or semi-flexible body having an inside surface, fastening means for attaching the body to the mouthpiece, a cradle connected to the inside surface of the body, an interchangeable insert received in the cradle, a pair of opposing flexible flaps attached to the inside surface of the body adjacent to the cradle, wherein the inside surface of the body is adjacent to the musical instrument and secured thereto with the fastening means such that the insert in the cradle is juxtapositioned to the reed in the mouthpiece and the flaps are disposed in a predetermined position with respect to the cradle and wherein desired tonal effects are obtained by selection of the insert and positioning of the flaps.

2. The ligature of claim 1, wherein the body is flexible and is a unitary strip having a first end and a second end, the strip being folded and forming a "C" shape having a mouth, an inner wall and an outer wall, the ends of the strip being disposed within the outer wall opposite the mouth and forming the opposing flaps as a portion of the inner wall.

3. The ligature of claim 2, wherein a respective rod is disposed between the inner wall and the outer wall on each side of the mouth.

4. The ligature of claim 3, wherein the fastening means is connected to the rods.

5. The ligature of claim 1, wherein the insert is frictionally held in the cradle.

6. The ligature of claim 1, wherein the insert is a bent rigid member.

7. The ligature of claim 6, wherein a plurality of inserts is provided, each having a different thickness such that a selected insert or no insert may be received in the cradle.

8. The ligature of claim 1, wherein the flaps are disposed above the cradle when the ligature is connected to the mouthpiece.

9. The ligature of claim 1, wherein the flaps are disposed below the cradle when the ligature is connected to the mouthpiece.

10. The ligature of claim 1, wherein one flap is disposed below the cradle and the other flap is disposed above the cradle when the ligature is connected to the mouthpiece.

11. The ligature of claim 1, wherein the flexible body is a coated fabric.

12. The ligature of claim 1, wherein the semi-flexible body is metal.

13. The ligature of claim 1, wherein each flap has a plurality of spaced-apart slits formed longitudinally therein.

14. The ligature of claim 1, wherein the cradle has a base having a face and a pair of spaced-apart arms formed on the face of the base, the arms being folded toward one another to resiliently retain the insert within the cradle.

15. The ligature of claim 1, wherein the semi-flexible body is a unitary strip having a first end and a second end, the strip being folded and forming a "C" shape having a mouth and an outer wall, a respective flexible segment being attached to each, the first end and the second end to form a respective flap.

16. A ligature for use on a mouthpiece of a woodwind type musical instrument, the ligature comprising:

a body formed from a flexible or a semi-flexible unitary strip having a first end and an opposite second end, the strip being folded forming a "C" shaped body having a mouth, an outer wall and an inner wall, opposing flaps being formed within the inner wall, a respective rod being disposed within the inner wall and the outer wall on each side of the mouth, fastening means being connected to each of the rods for attachment of the body of the ligature around the mouthpiece of the instrument, a cradle connected to the inner wall of the body of the ligature opposite to the mouth, an interchangeable insert retained in the cradle, wherein the body of the ligature is secured around the mouthpiece of the instrument by the fastening means with the insert in the cradle juxtapositioned to the mouthpiece and the flaps are disposed in a predetermined position with respect to the cradle and wherein desired tonal effects are obtained by selection of the insert and positioning of the flaps.

17. The ligature of claim 16, wherein a plurality of inserts are provided, each having a different thickness such that a selected insert or no insert may be received in the cradle.

18. The ligature of claim 16, wherein the flaps are positioned below the cradle.

19. The ligature of claim 16, wherein the flaps are positioned above the cradle.

20. The ligature of claim 16, wherein one flap is positioned below the cradle and the other flap is disposed above the cradle.

21. The ligature of claim 16, wherein each flap has a plurality of spaced-apart slits formed longitudinally therein.

22. The ligature of claim 16, wherein the cradle has a base having a face, and a pair of spaced-apart arms formed on the face of the base, the arms being folded toward one another to resiliently retain the insert within the cradle.

23. A ligature for use on a mouthpiece of a woodwind type musical instrument having a reed, the ligature comprising:

a flexible or semi-flexible body having an inside surface, fastening means for attaching the body to the mouthpiece, a cradle connected to the inside surface of the body, the cradle having a base having a face, a pair of spaced-apart arms being formed on the face of the base, the arms being folded toward one another, an insert received between the folded arms and the face on the base, wherein the body is secured around the mouthpiece of the musical instrument by the fastening means with the insert in the cradle juxtapositioned to the reed in the mouthpiece and desired tonal effects are produced.

24. The ligature of claim 23, wherein the body is a flexible unitary strip having a first end and a second end, the strip being folded and forming a "C" shape having a mouth, an inner wall and an outer wall, the ends of the strip being disposed within the outer wall opposite the mouth and forming opposing flaps.

25. The ligature of claim 23, wherein the insert is a bent rigid member.

26. The ligature of claim 23, wherein a plurality of inserts are provided, having a different thickness such that a selected insert or no insert may be received in the cradle.

27. The ligature of claim 24, wherein each flap has a plurality of spaced-apart slits formed longitudinally therein.

28. The ligature of claim 23, wherein the body is a unitary strip having a first end and a second end, the strip being folded and forming a "C" shape having a mouth and an outer wall, a respective flexible segment being attached to each of the first end and the second end to form a respective flap.

* * * * *